US010685822B2

(12) United States Patent
Endo et al.

(10) Patent No.: US 10,685,822 B2
(45) Date of Patent: Jun. 16, 2020

(54) CEM ASSEMBLY AND ELECTRON MULTIPLIER DEVICE

(71) Applicant: HAMAMATSU PHOTONICS K.K., Hamamatsu-shi, Shizuoka (JP)

(72) Inventors: Takeshi Endo, Hamamatsu (JP); Hiroshi Kobayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/665,065

(22) Filed: Oct. 28, 2019

(65) Prior Publication Data

US 2020/0135439 A1 Apr. 30, 2020

(30) Foreign Application Priority Data

Oct. 30, 2018 (JP) ..... 2018-204147

(51) Int. Cl.
*H01J 43/30* (2006.01)
*H01J 43/12* (2006.01)

(52) U.S. Cl.
CPC ..... *H01J 43/30* (2013.01); *H01J 43/12* (2013.01)

(58) Field of Classification Search
None
See application file for complete search history.

(56) References Cited

U.S. PATENT DOCUMENTS 4,888,461 A * 12/1989 Takano ..... H05B 6/685 219/716
5,440,115 A * 8/1995 Bauco ..... H01J 43/30 250/207
5,568,013 A * 10/1996 Then ..... H01J 43/246 313/103 CM
6,166,365 A * 12/2000 Simonetti ..... H01J 43/24 250/207
8,618,457 B2 12/2013 Wright
8,648,500 B1 * 2/2014 Jenkins ..... G05F 1/46 307/112
9,824,845 B2 * 11/2017 Cheatham, III ..... H01J 29/02
(Continued)

FOREIGN PATENT DOCUMENTS

JP S62-126540 A 6/1987
JP 2990321 B2 12/1999
JP 2006-66394 A 3/2006

*Primary Examiner* — Alexander H Taningco
*Assistant Examiner* — Syed M Kaiser
(74) *Attorney, Agent, or Firm* — Faegre Drinker Biddle & Reath LLP

(57) ABSTRACT

According to an embodiment, in a CEM assembly and the like, it is possible to reduce a size of a voltage supply circuit configured to stabilize a voltage to be applied to a channel electron multiplier. The CEM assembly includes a CEM and a voltage supply circuit. The CEM includes an input electrode, a multiplication channel, and an output electrode. The voltage supply circuit includes a power source unit and a constant voltage generation unit. A potential of an input electrode A is set by an electromotive force generated by the power source unit. The constant voltage generation unit includes a constant voltage supply unit configured to cause voltage drop. A target potential set at an output-side reference node is maintained by the voltage drop of the constant voltage supply unit.

12 Claims, 10 Drawing Sheets

(56) References Cited

U.S. PATENT DOCUMENTS

| | | | | |
|---|---|---|---|---|
| 2007/0131849 | A1* | 6/2007 | Beaulieu | H01J 29/023 250/214 VT |
| 2008/0149923 | A1* | 6/2008 | Ohsawa | C09K 11/06 257/40 |
| 2009/0073547 | A1* | 3/2009 | Fujimori | G02F 1/0311 359/318 |
| 2009/0268072 | A1* | 10/2009 | Makiyama | H04N 5/359 348/311 |
| 2011/0069059 | A1* | 3/2011 | Lee | G05F 1/56 345/212 |
| 2011/0140902 | A1* | 6/2011 | Huss | H01H 85/32 340/638 |
| 2013/0002746 | A1* | 1/2013 | Takayanagi | B41J 29/38 347/14 |
| 2014/0265829 | A1* | 9/2014 | Hosea | H01J 43/025 315/12.1 |
| 2018/0082865 | A1* | 3/2018 | Sasaki | H01L 21/22 |
| 2018/0247802 | A1* | 8/2018 | Nagata | H01J 43/246 |
| 2019/0164734 | A1* | 5/2019 | Kobayashi | H01J 1/34 |
| 2019/0211219 | A1* | 7/2019 | Kondo | C09K 11/06 |
| 2019/0295920 | A1* | 9/2019 | Otremba | H01L 25/115 |

* cited by examiner

CEM ASSEMBLY AND ELECTRON MULTIPLIER DEVICE

TECHNICAL FIELD

The present invention relates to a CEM assembly including a channel electron multiplier (described as "a CEM" below) and an electron multiplier device including the CEM assembly.

BACKGROUND

A CEM having an electron multiplication function includes a multiplication channel in which a secondary electron emission layer is provided, via a resistive layer, on an inner wall surface of a through-hole formed in a structural body or on a surface of defining a groove provided in the surface of the structural body. An input electrode is provided at an input end of the multiplication channel, and an output electrode set to have a potential higher than a set potential of the input electrode is provided at an output end of the multiplication channel. If charged particles taken from the input end reach a secondary electron emission surface, secondary electrons are emitted from the secondary electron emission surface. The emitted secondary electrons are multiplied in a cascade manner while propagating from the input electrode toward the output electrode.

The above-described CEM constitutes a CEM assembly along with a voltage supply circuit for applying a predetermined voltage between the input electrode and the output electrode, and the CEM assembly is applied to various sensing devices. As an example, the CEM assembly is combined with a structure (for example, electrode such as an anode) of collecting electrons emitted from the CEM, and thus may be applied to an electron multiplier device or the like which is widely used in the technical field of ion detection or the like.

SUMMARY

The inventors have examined a channel electron multiplier (CEM) in the related art and a CEM assembly including a voltage supply circuit applied thereto, and have found problems as follows.

That is, the CEM in the related art in which a secondary electron emission layer and the like are formed in a structural body comprised of lead glass has required a resistance value (resistance value from the input end of the multiplication channel to the output end) of 10 MΩ or larger in order to ensure a stable operation. In the CEM in the related art in which lead glass is applied for the structural body, a lead layer deposited by the reduction treatment of PbO is used as the resistance layer. In recent years, a low-resistance CEM in which a resistive film and a secondary electron emission film are formed by atomic layer deposition (described as "ALD" below) on the surface of a structural body comprised of an insulating material or ceramic is manufactured.

In particular, in the above-described single low-resistance CEM, the resistance value of the CEM is decreased by heat generated in operation, or voltage drop occurs at an output end by an increase of an output current. Such a decrease of the output potential of the CEM causes an increase in the gain of the CEM, such that there is a problem in that the linearity (described as "DC linearity" below) of the CEM by DC voltage control is lost. There are individual differences in resistance value between a plurality of manufactured CEMs. Therefore, "an individual difference in resistance value between CEMs" is also required to be considered for fixing the output potential of the CEM.

In this specification, "DC linearity" means operation characteristics of a CEM, which are calculated by a ratio (described as "an input-and-output current ratio) of an input amount (in terms of a current value) of charged particles to the CEM and an output current of the CEM. When the input amount of the charged particles to the CEM is small, the input-and-output current ratio shows a constant value (linearity). However, in a case where charged particles of an excessive amount are inputted to the CEM, the input-and-output current ratio deviates (±10%) from a reference value. The reference value (a.u.) is an input-and-output current ratio in a range in which DC linearity can be sufficiently ensured (range where the output current is as low as about 1 to 100 nA), and is given by the following Expression (1).

$$\text{Output current(A)/input amount(A) of charged particles} \quad (1)$$

DC linearity (%) is given by the following Expression (2). Thus, in a case of a range in which the output current is relatively low, the input-and-output current ratio is necessarily substantially equal to the reference value (DC linearity is 100%). However, as the output current increases beyond the above range, the voltage drop at the output end of the CEM increases, and thus a difference between the input-and-output current ratio and the reference value becomes significant (DC linearity is broken).

$$\text{Output current(A)/input amount(A) of charged particles/reference value(a.u.)}\times 100 \quad (2)$$

Here, "the input amount of charged particles" is given as a current value based on charged particles reaching the input end of the CEM. "The output current" is given as a current value based on electrons reaching an anode from the CEM.

As means for solving deterioration of DC linearity by fluctuation of the output potential in the above-described CEM, for example, a method of providing a power source unit configured to set an input potential of the CEM and a power source unit configured to set an output potential of the CEM is considered. However, a voltage supply circuit including such two power source units has a problem in that manufacturing cost of a CEM assembly including the CEM increases, and it is difficult to reduce a size of the CEM assembly.

The present invention has been made to solve the above-described problems, and an object thereof is to provide a CEM assembly having a structure for avoiding an increase in size of the CEM assembly including a CEM and substantially fixing an output potential of the CEM, and an electron multiplier device including the CEM assembly as an example of an application technology.

According to an embodiment, a CEM assembly comprised a channel electron multiplier, and a voltage supply circuit including a power source unit (this power source unit generates the entirety of an electromotive force in a circuit) configured to apply a predetermined voltage to the channel electron multiplier. The channel electron multiplier includes at least a multiplication channel, an input electrode, and an output electrode. The multiplication channel includes an input end for taking charged particles in, an output end for emitting secondary electrons, and a secondary electron emission layer continuously provided from the input end toward the output end. The input electrode is provided at the input end of the multiplication channel in a state of being in contact with the secondary electron emission layer. The output electrode is provided at the output end of the multiplication channel in a state of being in contact with the secondary electron emission layer. The voltage supply circuit includes one power source unit in the entirety of the circuit. A predetermined voltage is applied between the input electrode and the output electrode by the power source unit. In particular, the voltage supply circuit includes a first terminal set to a first reference potential, a second terminal connected to the input electrode, a third terminal connected to the output electrode, a fourth terminal set to a second reference potential, and a constant voltage generation unit, in addition to the power source unit. Here, the power source unit generates an electromotive force for ensuring a potential difference between the first terminal and an input-side reference node. The constant voltage generation unit is disposed between the third terminal and the fourth terminal to hold a target potential for adjusting a potential of the output electrode. The constant voltage generation unit includes a constant voltage supply unit provided to cause voltage drop for ensuring a potential difference between the fourth terminal and an output-side reference node.

Further, according to an embodiment, as an example of an application technology to which the CEM assembly having the above-described structure is applied, an electron multiplier device includes the CEM assembly having the above-described structure, and an anode disposed so as to face the output end of the CEM to collect electrons outputted from the output end of the CEM.

The embodiments according to the present invention can be more sufficiently understood from the following detailed descriptions and the accompanying drawings. The examples are given just for the purpose of illustration and should not be considered as limiting the present invention.

Further application range of the present invention will be apparent from the following detailed descriptions. However, the detailed description and specific examples show the preferred embodiment of the invention, but this is just an example. Various modifications and improvements in the scope of the present invention will be apparent to those skilled in the art from the detailed descriptions.

DETAILED DESCRIPTION

Descriptions of Embodiments of Invention

Figure 1:
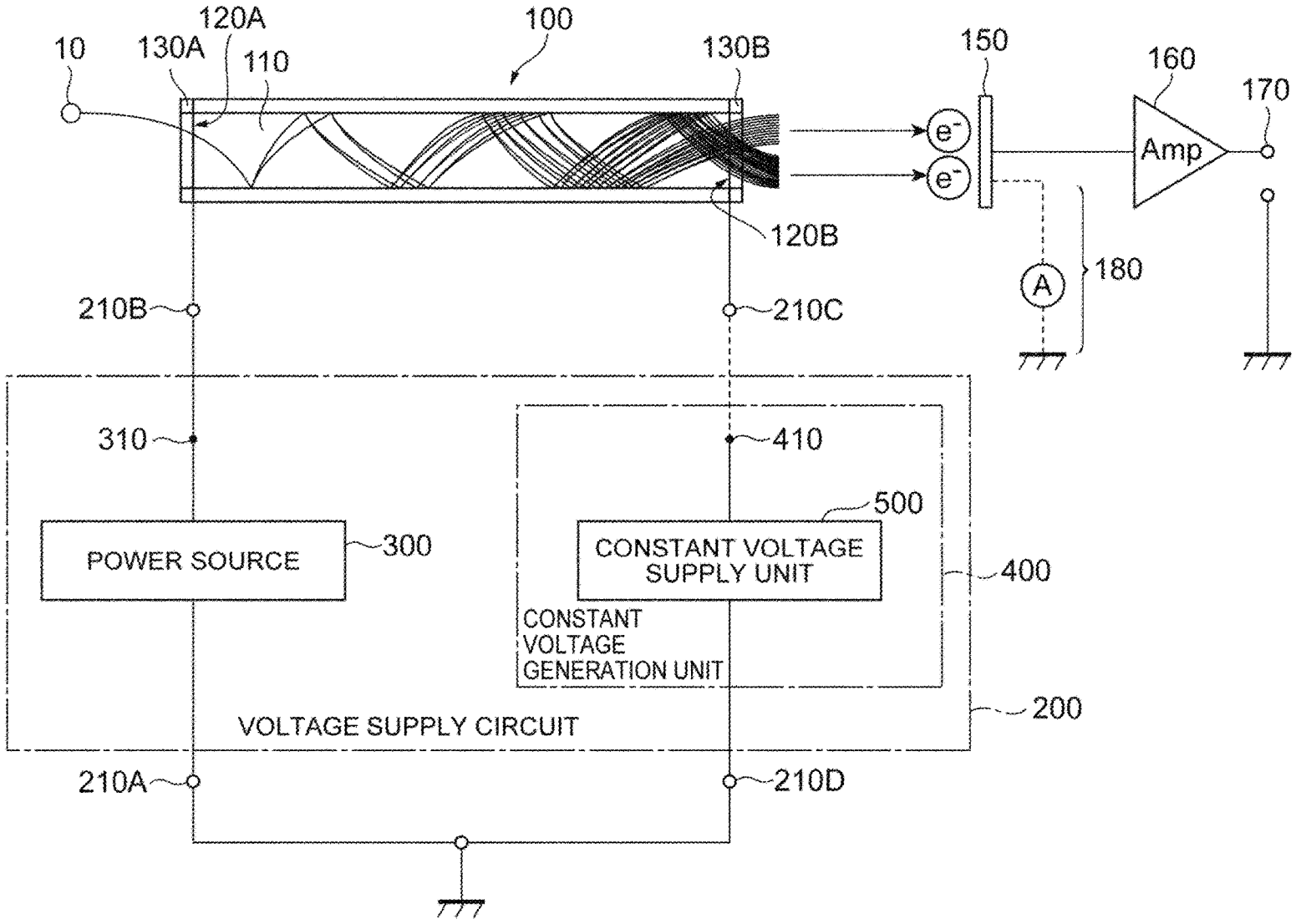
FIG. 1 is a diagram illustrating a representative configuration example (signal output configuration and current measurement configuration) of an electron multiplier device (including a CEM assembly according to an embodiment) according to the embodiment.

Firstly, details of embodiments of the present application invention will be individually described in order.

(1) According to an aspect of an embodiment, a CEM assembly comprises a channel electron multiplier (CEM), and a voltage supply circuit including a power source unit (this power source unit generates the entirety of an electromotive force in a circuit) configured to apply a predetermined voltage to the CEM. The CEM includes, at least, a multiplication channel, an input electrode, and an output electrode. The multiplication channel has an input end for taking charged particles in, an output end for emitting a secondary electron, and a secondary electron emission layer continuously provided from the input end toward the output end. The input electrode is provided at the input end of the multiplication channel in a state of being in contact with the secondary electron emission layer. The output electrode is provided at the output end of the multiplication channel in a state of being in contact with the secondary electron emission layer. The voltage supply circuit includes one power source unit in the entirety of the circuit. A predetermined voltage is applied between the input electrode and the output electrode by the power source unit.

In particular, the voltage supply circuit includes a first terminal set to a first reference potential, a second terminal connected to the input electrode, a third terminal connected to the output electrode, a fourth terminal set to a second reference potential, and a constant voltage generation unit, in addition to the power source unit. Each of the first reference potential and the second reference potential may be connected to a common terminal set to a ground potential, for example (the first reference potential and the second reference potential may be equal to each other). The power source unit is disposed between the first terminal and the second terminal. The power source unit generates an electromotive force for ensuring a potential difference between the first terminal and an input-side reference node. The input-side reference node is a node which is set to the same potential as the potential of the input electrode via the second terminal and is located between the first terminal and the second terminal. The constant voltage generation unit is disposed between the third terminal and the fourth terminal and holds a target potential for adjusting a potential of the output electrode. The constant voltage generation unit includes an output-side reference node and a constant voltage supply unit provided to cause voltage drop for ensuring a potential difference between the fourth terminal and the output-side reference node. That is, in the constant voltage supply unit, the power source unit generating an electromotive force is not disposed between the third terminal and the fourth terminal. The output-side reference node is a node set to the target potential for adjusting the potential of the output electrode and is a node located between the third terminal and the fourth terminal.

(2) According to another aspect of the embodiment, preferably, the constant voltage generation unit further includes a first resistor and a potential fixing element. The first resistor is disposed between the input-side reference node and the output-side reference node. The potential fixing element has a function to eliminate a potential difference between the output electrode and the output-side reference node via the third terminal.

(3) According to still another aspect of the embodiment, preferably, the constant voltage supply unit includes a second resistor disposed between the output-side reference node and the fourth terminal. According to still another aspect of the embodiment, preferably, the resistance value of the first resistor is higher than the resistance value of the second resistor. Further, according to still another aspect of the embodiment, preferably, the resistance ratio between the first resistor and the second resistor is set to be within a range of 100:1 to 2:1.

(4) According to still another aspect of the embodiment, preferably, the constant voltage supply unit includes a Zener diode disposed between the output-side reference node and the fourth terminal.

(5) According to still another aspect of the embodiment, preferably, the potential fixing element includes any of a MOS transistor, a FET, and a bipolar transistor. In a case where such a three-terminal element is applied as the potential fixing element, the potential fixing element has a first element end connected to the output-side reference node, a second element end connected to the third terminal, and a third element end connected to the fourth terminal.

(6) According to still another aspect of the embodiment, preferably, the constant voltage supply unit may include one or more IC units connected in series between the output-side reference node and the fourth terminal. In this case, the output-side reference node is electrically connected to the output electrode via the third terminal. Each of the IC units includes a shunt regulator IC, a third resistor, and a fourth resistor. The third resistor and the fourth resistor are connected in series between an input end and an output end of the shunt regulator IC at a predetermined resistance ratio.

(7) According to still another aspect of the embodiment, preferably, the multiplication channel further includes a structural body provided to support a secondary electron emission layer and being comprised of an insulating material, and a resistive film provided between the secondary electron emission layer and the structural body. According to still another aspect of the embodiment, preferably, the insulating material includes ceramic or glass excluding lead glass or ceramic.

(8) According to still another aspect of the embodiment, preferably, the resistance value of the multiplication channel located between the input electrode and the output electrode is less than 10 MΩ.

(9) According to an aspect of an embodiment, as an example of an application technology to which the CEM assembly having the above-described structure, an electron multiplier device includes the CEM assembly having the above-described structure and an anode. The anode is an electrode disposed to face the output end of the CEM and has a function to collect electrons outputted from the output end of the CEM.

As described above, each of the aspects listed in this section [Description of Embodiments of Invention] is applicable to each of all the remaining aspects or to all combinations of the remaining aspects.

DETAILS OF EMBODIMENT OF INVENTION

A specific example of the CEM assembly and the electron multiplier device including the CEM assembly according to the invention will be described below in detail with reference to the accompanying drawings. Regarding the embodiment disclosed below, it is assumed that an example of an electron multiplier device among various sensing devices to which the CEM assembly according to the present invention is applied will be described. The present invention is not limited to the descriptions. The present invention is defined by the claims, and is intended to include any change within the meaning and the scope equivalent to those of the claims. In the descriptions of the drawings, the same components are denoted by the same reference signs, and repetitive descriptions will be omitted.

FIG. 1 is a diagram illustrating a representative configuration example of an electron multiplier device (including a CEM assembly according to an embodiment) according to the embodiment. According to the embodiment, the electron multiplier device illustrated in FIG. 1 includes the CEM assembly according to the embodiment, an anode 150, and a signal output circuit. The CEM assembly includes a channel electron multiplier (CEM) 100 and a voltage supply circuit 200. In the example in FIG. 1, the signal output circuit (the signal output configuration) includes an amplifier 160 (described as "Amp" in FIG. 1) disposed between a signal output terminal 170 and the anode 150. The signal output terminal 170 is a terminal for taking out electrons reaching the anode 150 as an electrical signal. A current measurement circuit 180 including an ammeter (described as "A" in FIG. 1) may be connected to the anode 150 instead of the signal output circuit (current measurement configuration).

Firstly, in the example in FIG. 1, the CEM 100 includes a multiplication channel 110, an input electrode 130A provided at an input end 120A of the multiplication channel, and an output electrode 130B provided at an output end 120B of the multiplication channel 110. A secondary electron emission layer is provided on the inner wall surface of the multiplication channel 110. The secondary electron emission layer is continuously formed from the input electrode 130A toward the output electrode 130B. The input end side of the secondary electron emission layer is in contact with the input electrode 130A. The output end side of the secondary electron emission layer is in contact with the output electrode 130B. If charged particles 10 reach the secondary electron emission layer from the input end 120A, secondary electrons are emitted from the secondary electron emission layer. The emitted secondary electrons are multiplied in a cascade manner while traveling from the input electrode 130A toward the output electrode 130B.

The voltage supply circuit 200 configured to apply a predetermined voltage between the input electrode 130A and the output electrode 130B includes a single power source unit 300 (only the power source unit 300 generates an electromotive force in the entirety of the circuit) generating the entirety of the electromotive force in the circuit, first to fourth terminals 210A to 210D, and a constant voltage generation unit 400. In particular, the first terminal 210A is set to a first reference potential (set to a ground potential via the common terminal in the example in FIG. 1). The second terminal 210B is connected to the input electrode 130A. The third terminal 210C is connected to the output electrode 130B. The fourth terminal 210D is set to a second reference potential (set to the ground potential via the common terminal in the example in FIG. 1).

In the voltage supply circuit 200, an input-side reference node 310 is located between the power source unit 300 and the second terminal 210B. The input-side reference node 310 is a node set to the same potential as the potential of the input electrode 130A via the second terminal 210B. The power source unit 300 generates an electromotive force for ensuring a potential difference between the first terminal 210A and the input-side reference node 310.

In the voltage supply circuit 200, the constant voltage generation unit 400 is disposed between the third terminal 210C and the fourth terminal 210D and holds a target potential for fixing the potential of the output electrode 130B. The target potential is set for an output-side reference node 410 which is not influenced by potential fluctuation of the output electrode 130B. Specifically, the potential difference between the fourth terminal 210D and the output-side reference node 410 is ensured by voltage drop by a constant voltage supply unit 500. The output-side reference node 410 is a node set to the target potential for adjusting the potential of the output electrode 130B and is a node which is directly or indirectly connected to the third terminal 210C.

Figure 2A:
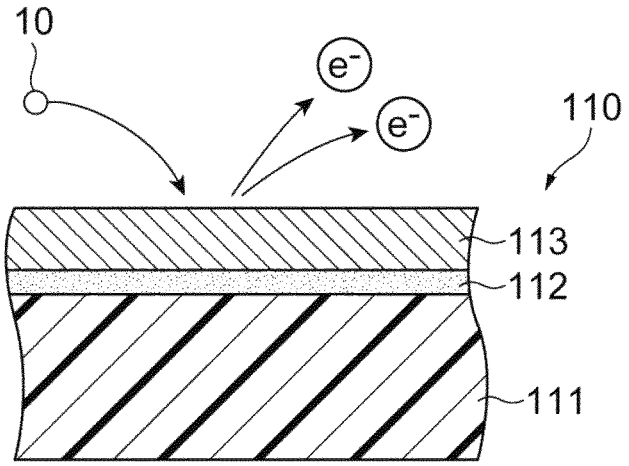
FIG. 2A is a diagram illustrating a sectional structure of a multiplication channel.
Figure 2B:
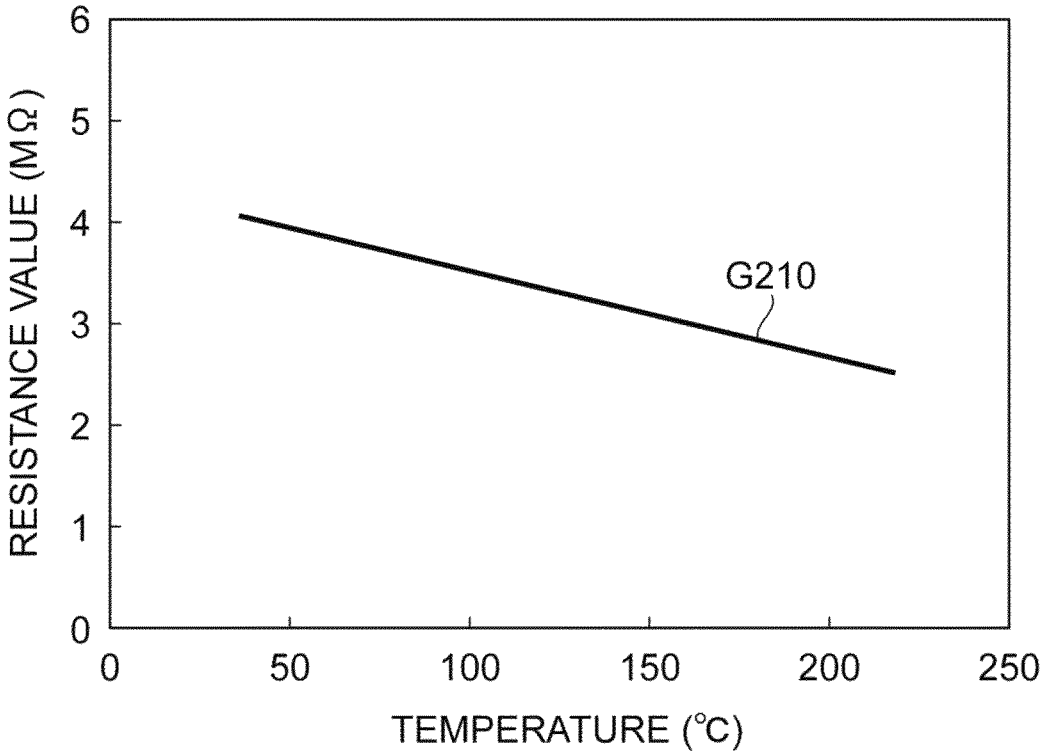
FIG. 2B is a graph illustrating a general tendency of temperature dependency of a resistance value in the multiplication channel.

FIG. 2A is a diagram illustrating a sectional structure of the multiplication channel 110. FIG. 2B is a graph illustrating a general tendency of temperature dependency of a resistance value in the multiplication channel 110.

As illustrated in FIG. 2A, the multiplication channel 110 has a structure in which a resistive layer 112 and a secondary electron emission layer 113 are sequentially stacked on a structural body 111 comprised of an insulating material (except lead glass) or ceramic. In the multiplication channel 110 having such a sectional structure, the resistance value of the resistive layer 112 is preferably less than 10 MΩ, and is 2 MΩ in the example of the embodiment. If charged particles 10 reach the surface of the secondary electron emission layer 113, secondary electrons are emitted from the secondary electron emission layer 113. In the example in FIG. 1, the multiplication channel 110 is formed on the inner wall surface of the cylindrical structural body. The shape of the CEM 100 is not limited to the cylindrical shape. For example, the multiplication channel 110 may be formed on a constituting surface (surface defining a sectional shape of a groove) of the groove formed in the surface of a plate-like structural body.

FIG. 2B is a graph illustrating a general tendency of temperature dependency of the resistance value in the multiplication channel 110 having the above-described sectional structure. in FIG. 2B, a vertical axis indicates the resistance value (MΩ), and a horizontal axis indicates a temperature (° C.). As in a graph G210 in FIG. 2B, in the CEM (low-resistance CEM having a resistance value which is less than 10 MΩ) 100 as in the embodiment, it is recognized that the resistance value is reduced with an increase of the temperature. As described above, in the CEM 100, it is possible to recognize temperature characteristics in which, if the temperature of the multiplication channel 110 increases by heat generation in an operation of electron multiplication, voltage drop occurs on the output end 120B side.

Figure 3A:
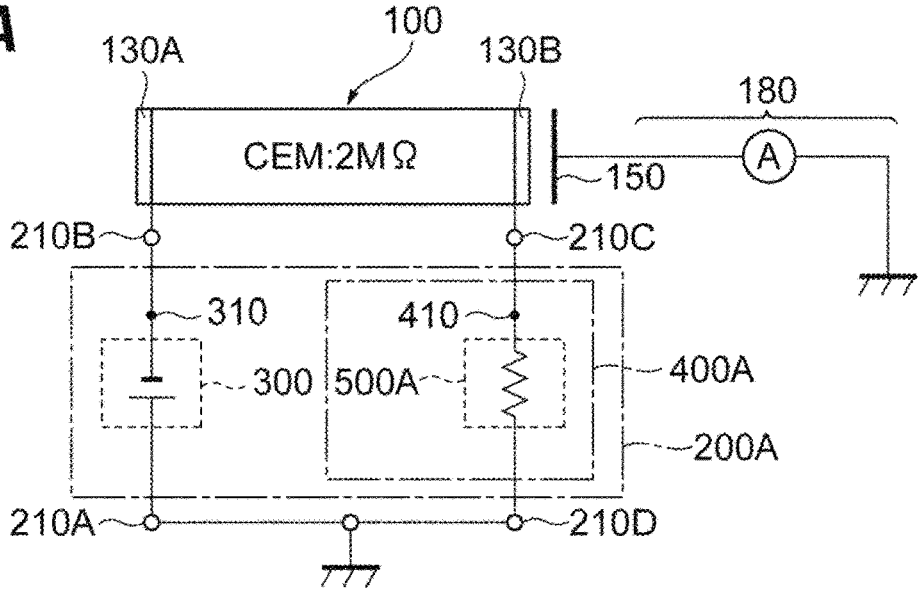
FIG. 3A is a diagram illustrating a configuration example (current measurement configuration) of an electron multiplier device (including a CEM assembly including a single power source unit) according to a first comparative example.

FIG. 3A is a diagram illustrating a configuration example of an electron multiplier device according to a first comparative example, which includes a CEM assembly including a single power source unit when the entirety of the voltage supply circuit is viewed. In the example in FIG. 3A, as the current measurement configuration, a current measurement circuit (including an ammeter) 180 is connected to the anode 150 that captures secondary electrons from the CEM 100. A configuration example of an electron multiplier device according to a second comparative example is not particularly illustrated, but has a configuration in which another power source unit for generating an electromotive force is disposed instead of a constant voltage supply unit 500A configured by a resistor in the configuration of the CEM assembly in the first comparative example of FIG. 3A.

In the electron multiplier device according to the first comparative example, the configurations of the CEM (low-resistance CEM having a resistance value of 2 MΩ) 100 constituting a portion of the CEM assembly, the anode 150, and the current measurement circuit 180 (or signal output circuit including the amplifier 160) are the same as those in the configuration example in FIG. 1. A voltage supply circuit 200A constituting a portion of the CEM assembly includes the power source unit 300, similar to the configuration example in FIG. 1. However, a potential setting structure of the output electrode 130B is different from the configuration example in FIG. 1. That is, in a constant voltage generation unit 400A included in the voltage supply circuit 200A, the output-side reference node 410 is connected to the output electrode 130B via the third terminal 210C. In the constant voltage generation unit 400A, a constant voltage supply unit 500A is configured by a resistor having one end connected to the output-side reference node 410 and the other end connected to the fourth terminal 210D. In the example in FIG. 3A, with the power source unit 300, the input-side reference node 310 is set to be −1000 to −4000 V, and the first terminal 210A and the fourth terminal 210D are set to the ground potential via the common terminal.

Figure 3B:
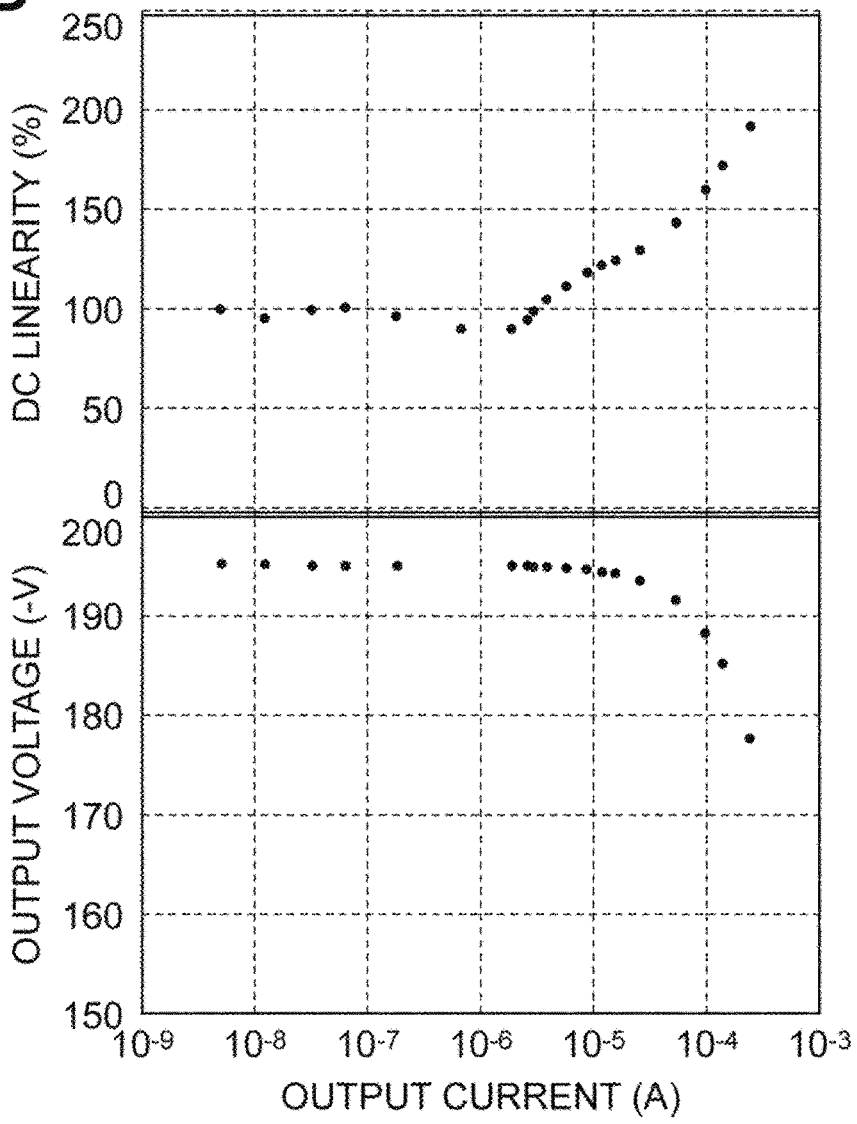
FIG. 3B is graphs illustrating relations between DC linearity (%) and an output current (A) and between an output voltage (−V) and the output current (A) in the electron multiplier device according to the first comparative example.

FIG. 3B is graphs illustrating a relation between DC linearity (%) and an output current (A) in the electron multiplier device (first comparative example) in FIG. 3A, which is configured as described above, and a relation between an output voltage (−V) and the output current (A). The resistance value of the constant voltage supply unit 500A is set to 0.1 MΩ (the resistance value of the CEM 100 is 2 MΩ). The input-side reference node 310 is set to −2200 V, and the output-side reference node 410 is set to −200 V.

As illustrated in FIG. 3B, according to the electron multiplier device according to the first comparative example, the output current obtained by the current measurement circuit 180 is rapidly reduced in a range of 1 to 10 μA. It is possible to recognize that the output voltage indicating a potential in the output electrode 130B is rapidly reduced after the output current exceeds 10 μA (occurrence of voltage drop). As described above, "DC linearity" is defined by a value obtained by expressing a proportion of the measured input-and-output current ratio to a reference value in a percentage manner when the input-and-output current ratio (output current/input amount of charged particles) in a range in which the output current is in a range of about 1 to 100 nA is set as the reference value.

Figure 4:
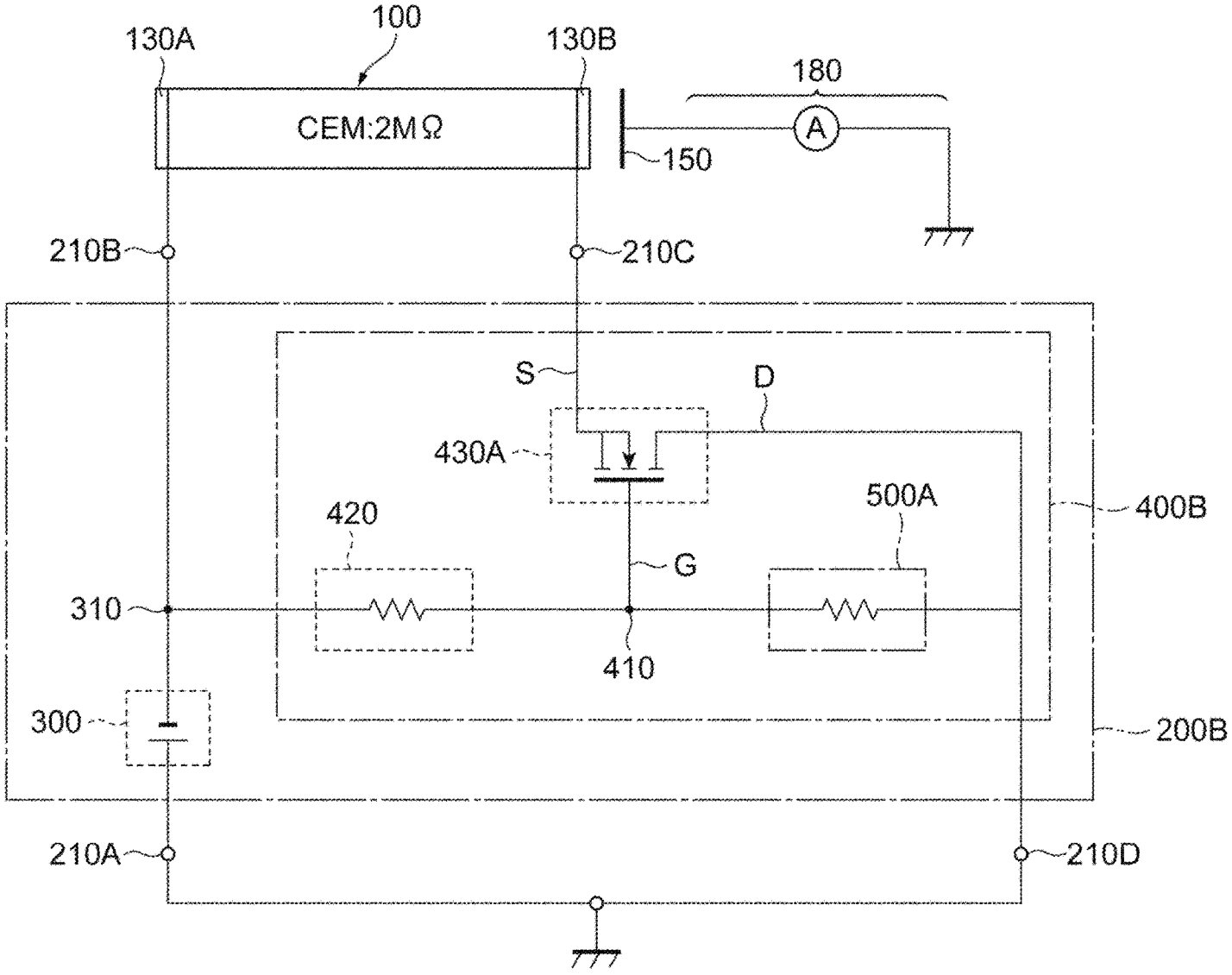
FIG. 4 is a diagram illustrating a specific configuration example (current measurement configuration) of an electron multiplier device (including a CEM assembly according to a first embodiment) according to the first embodiment.

FIG. 4 is a diagram illustrating a specific configuration example of an electron multiplier device (including a CEM assembly according to a first embodiment) according to the first embodiment. In the example in FIG. 4, as the current measurement configuration, the current measurement circuit (including an ammeter) 180 is connected to the anode 150 that captures secondary electrons from the CEM 100. The configuration illustrated in FIG. 4 corresponds to the configuration illustrated in FIG. 1.

The configuration of the electron multiplier device according to the first embodiment is similar to the configuration in the first comparative example, which is illustrated in FIG. 3A, except for a voltage supply circuit 200B constituting a portion of a CEM assembly according to the first embodiment. That is, the electron multiplier device according to the first embodiment includes the CEM assembly according to the first embodiment, the anode 150, and the current measurement circuit 180 (or the signal output circuit including an amplifier 160 as the signal output configuration) connected to the anode 150. The CEM assembly includes the CEM (low-resistance CEM having a resistance value of 2 MΩ) 100 and the voltage supply circuit 200B. The input electrode 130A is provided on the input end side of the CEM 100. The output electrode 130B is provided on the output end side of the CEM 100.

The voltage supply circuit 200B configured to apply a predetermined voltage between the input electrode 130A and the output electrode 130B includes the power source unit 300 configured to generate the entirety of the electromotive force in the circuit, the first to fourth terminals 210A to 210D, and a constant voltage generation unit 400B. The first terminal 210A is set to the ground potential (first and second reference potentials) via the common terminal. The second terminal 210B is connected to the input electrode 130A. The third terminal 210C is connected to the output electrode 130B. Similar to the first terminal 210A, the fourth terminal 210D is set to the ground potential via the common terminal.

In the voltage supply circuit 200B, the input-side reference node 310 is located between the power source unit 300 and the second terminal 210B. The power source unit 300 generates an electromotive force for ensuring a potential difference between the first terminal 210A and the input-side reference node 310. With this configuration, the input-side reference node 310 is set to −1000 to −4000 V.

In the voltage supply circuit 200B, the constant voltage generation unit 400B includes the first resistor 420, a potential fixing element 430A, and the constant voltage supply unit 500A. The first resistor 420 is disposed between the input-side reference node 310 and the output-side reference node 410. The constant voltage generation unit 400B is disposed between the third terminal 210C and the fourth terminal 210D and holds the target potential for fixing the potential of the output electrode 130B. The target potential is set for an output-side reference node 410 which is not influenced by potential fluctuation of the output electrode 130B. Specifically, the potential difference between the fourth terminal 210D and the output-side reference node 410 is ensured by voltage drop by the constant voltage supply unit 500A configured by a resistor (second resistor). The potential fixing element 430A configured by an N-type MOS transistor (described as "an NMOS" below) is disposed between the output-side reference node 410 and the third terminal 210C.

A gate G (first element end) of the NMOS is connected to the output-side reference node 410. A source S (second element end) of the NMOS is connected to the third terminal 210C. A drain D (third element end) of the NMOS is connected to the fourth terminal 210D. As the potential fixing element, any of a MOS transistor, a FET, and a bipolar transistor can be applied, as in this embodiment. Preferably, the resistance value of the first resistor 420 is preferably higher than the resistance value of the second resistor constituting the constant voltage supply unit 500A. The resistance ratio between the first resistor 420 and the second resistor is preferably set to be within a range of 100:1 to 2:1.

In the embodiment, if the output current increases (electrons emitted from the CEM 100 toward the anode 150 increase) in an operation of electron multiplication, voltage drop occurs on the output side (output electrode 130B) of the CEM 100. At this time, a voltage $V_{GS}$ between the gate G and the source S of the potential fixing element (NMOS) 430A increases, and the NMOS turns into an ON state at a time point at which $V_{GS}$ exceeds a threshold voltage. When the NMOS is in the ON state, instantaneously, electrons flow from the output electrode 130B toward the fourth terminal 210D via the third terminal 210C, and thus voltage drop of the output electrode 130B in the CEM 100 is eliminated. If the voltage drop is eliminated, $V_{GS}$ also decreases, and thus the NMOS turns into an OFF state. That is, the potential of the output electrode 130B is fixed to the target potential of the output-side reference node 410. As described above, according to this embodiment, it is possible to completely fix the resistance ratio between the first resistor 420 and the second resistor (constant voltage supply unit 500A) (the set potential of the output-side reference node 410 is not influenced by voltage fluctuation of the output electrode 130B).

Figure 5:
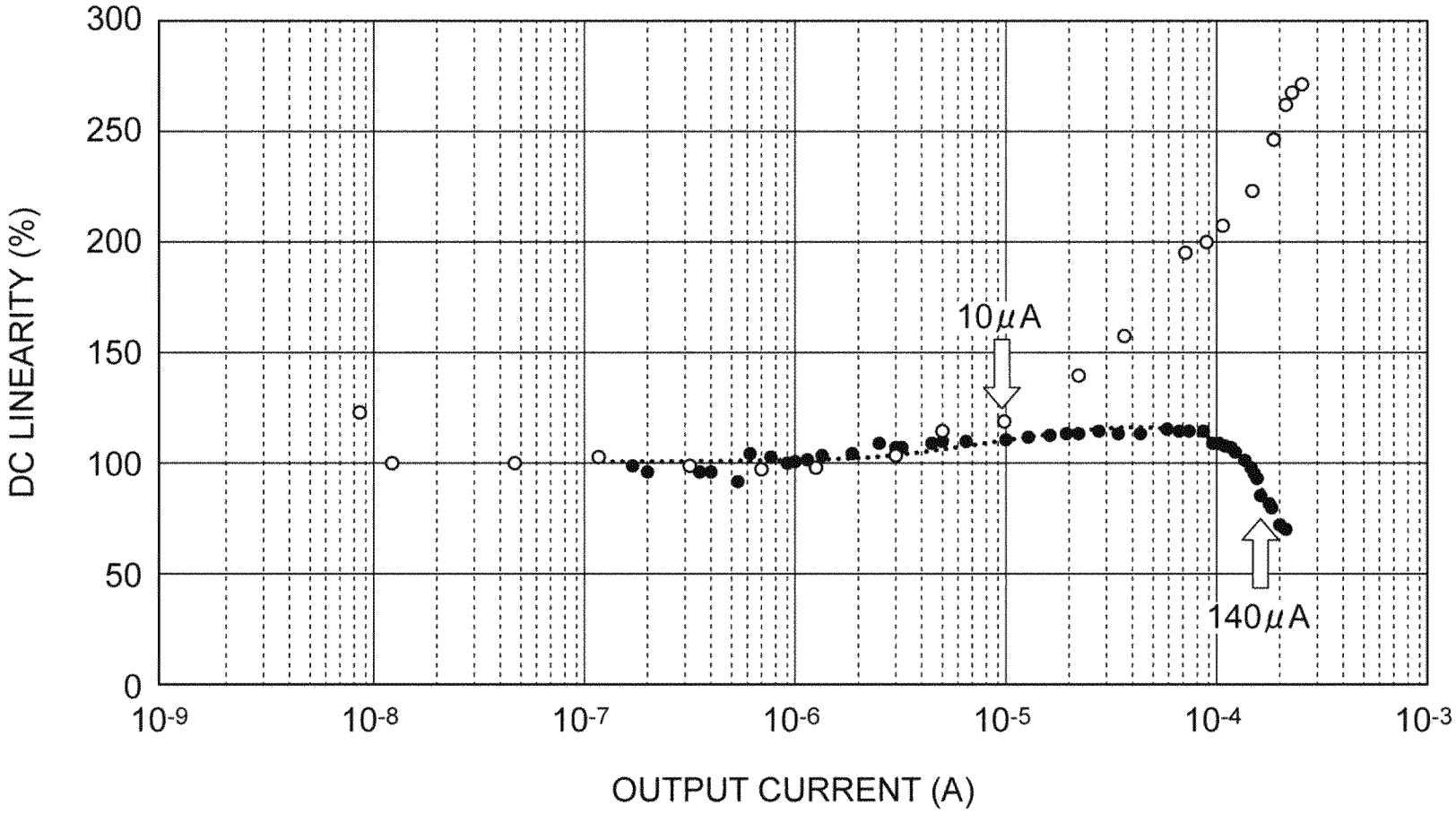
FIG. 5 is a graph illustrating a relation between DC linearity (%) and the output current (A) for each of the electron multiplier device according to the first comparative example in FIG. 3A and the electron multiplier device according to the first embodiment in FIG. 4.

FIG. 5 is a graph illustrating a relation between DC linearity (%) and the output current (A) for each of the electron multiplier device according to the first comparative example in FIG. 3A and the electron multiplier device according to the first embodiment in FIG. 4. In particular, in FIG. 5, a graph plotted by symbols "○" indicates a relation between DC linearity (%) and the output current (A) in the electron multiplier device according to the first comparative example in FIG. 3A. A graph plotted by symbols "●" indicates a relation between DC linearity (%) and the output current (A) in the electron multiplier device according to the first embodiment in FIG. 4.

In the first embodiment, the resistance value of the first resistor 420 is set to 20 MΩ, and the resistance value of the second resistor (constant voltage supply unit 500A) is set to 2 MΩ. The input-side reference node 310 is set to −1100 V, and the output-side reference node 410 is set to −100 V. The first comparative example in FIG. 3A has the same measurement conditions as those in FIG. 3B.

As understood from FIG. 5, in the first comparative example, DC linearity is rapidly deteriorated after the output current exceeds 10 μA. However, in this embodiment, DC linearity is stable until the output current exceeds 100 μA.

Figure 6:
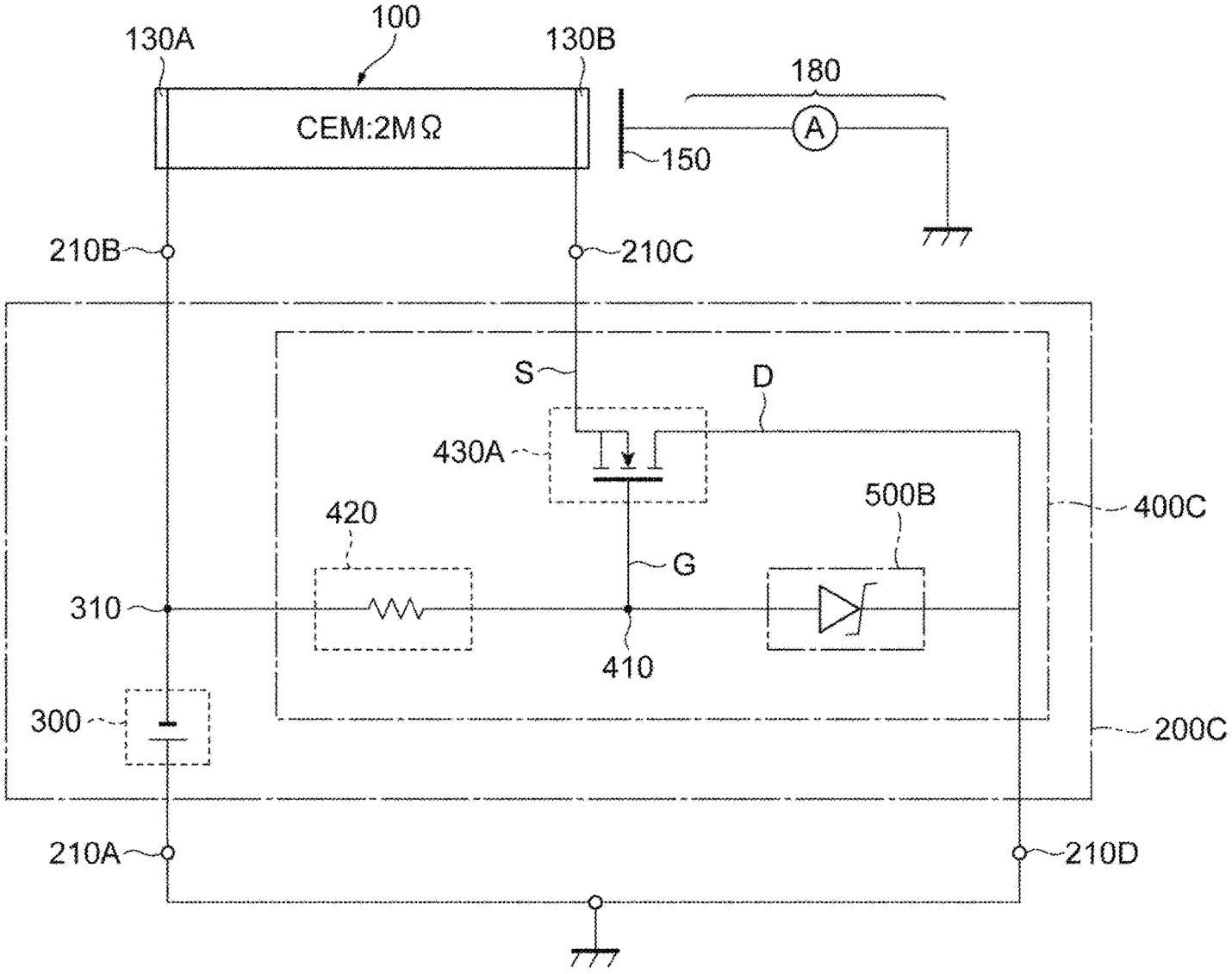
FIG. 6 is a diagram illustrating a specific configuration example (current measurement configuration) of an electron multiplier device (including a CEM assembly according to a second embodiment) according to the second embodiment.

FIG. 6 is a diagram illustrating a specific configuration example of an electron multiplier device (including a CEM assembly according to a second embodiment) according to the second embodiment. In the example in FIG. 6, as the current measurement configuration, the current measurement circuit (including an ammeter A) 180 is connected to the anode 150 that captures secondary electrons from the CEM 100. The configuration illustrated in FIG. 6 corresponds to the configuration illustrated in FIG. 1.

The electron multiplier device according to the second embodiment is different from the electron multiplier device according to the first embodiment illustrated in FIG. 4, in terms of the configuration of the CEM assembly. Specifically, the configuration of the CEM assembly according to the second embodiment is different from that in the first embodiment in that the CEM assembly includes a constant voltage supply unit 500B configured by a Zener diode instead of the constant voltage supply unit 500A configured by the second resistor illustrated in FIG. 4. That is, the electron multiplier device according to the second embodiment includes the CEM assembly according to the second embodiment, the anode 150, and the current measurement circuit 180 (or the signal output circuit including an amplifier 160 as the signal output configuration) connected to the anode 150. The CEM assembly includes the CEM (low-resistance CEM having a resistance value of 2 MΩ) 100 and a voltage supply circuit 200C. The CEM 100 includes the multiplication channel 110, the input electrode 130A, and the output electrode 130B. The voltage supply circuit 200C includes the first to fourth terminals 210A to 210D and includes the power source unit 300 disposed between the first terminal 210A and the input-side reference node 310 and a constant voltage generation unit 400C disposed between the third terminal 210C and the fourth terminal 210D. With the power source unit 300, the potential of the input-side reference node 310 is set to −1000 to −4000 V. The constant voltage generation unit 400C includes the first resistor 420 disposed between the input-side reference node 310 and the output-side reference node 410, the constant voltage supply unit 500B disposed between the output-side reference node 410 and the fourth terminal 210D, and a potential fixing element (NMOS) 430A disposed to eliminate a potential difference between the third terminal 210C and the output-side reference node 410. The constant voltage supply unit 500B is a Zener diode. With the Zener diode, the potential difference of −100 to −500 V is ensured between the output-side reference node 410 and the fourth terminal 210D.

With the CEM assembly having the above-described configuration according to the second embodiment, it is also possible to fix the potential of the output electrode 130B to the output-side reference node 410 in the CEM 100. The output potential (potential of the output electrode 130B) of the CEM 100 is required to about −100 V. As an example, in a case where the resistance ratio between the first resistor 420 and the second resistor (constant voltage supply unit 500A) is set to 10:1, when the set potential (potential of the input-side reference node 310) of the input electrode 130A is −1100 V, the set potential of the output electrode 130B becomes −100 V, and this is ideal. If the set potential of the input electrode 130A is changed to −2200 V, the set potential of the output electrode 130B becomes −200 V, and voltage loss of 100 V occurs. Thus, as in the second embodiment, if a Zener diode (constant voltage supply unit 500B) having $V_Z$=100 V is applied instead of the second resistor (constant voltage supply unit 500A), an operation with no voltage loss is possible.

Figure 7:
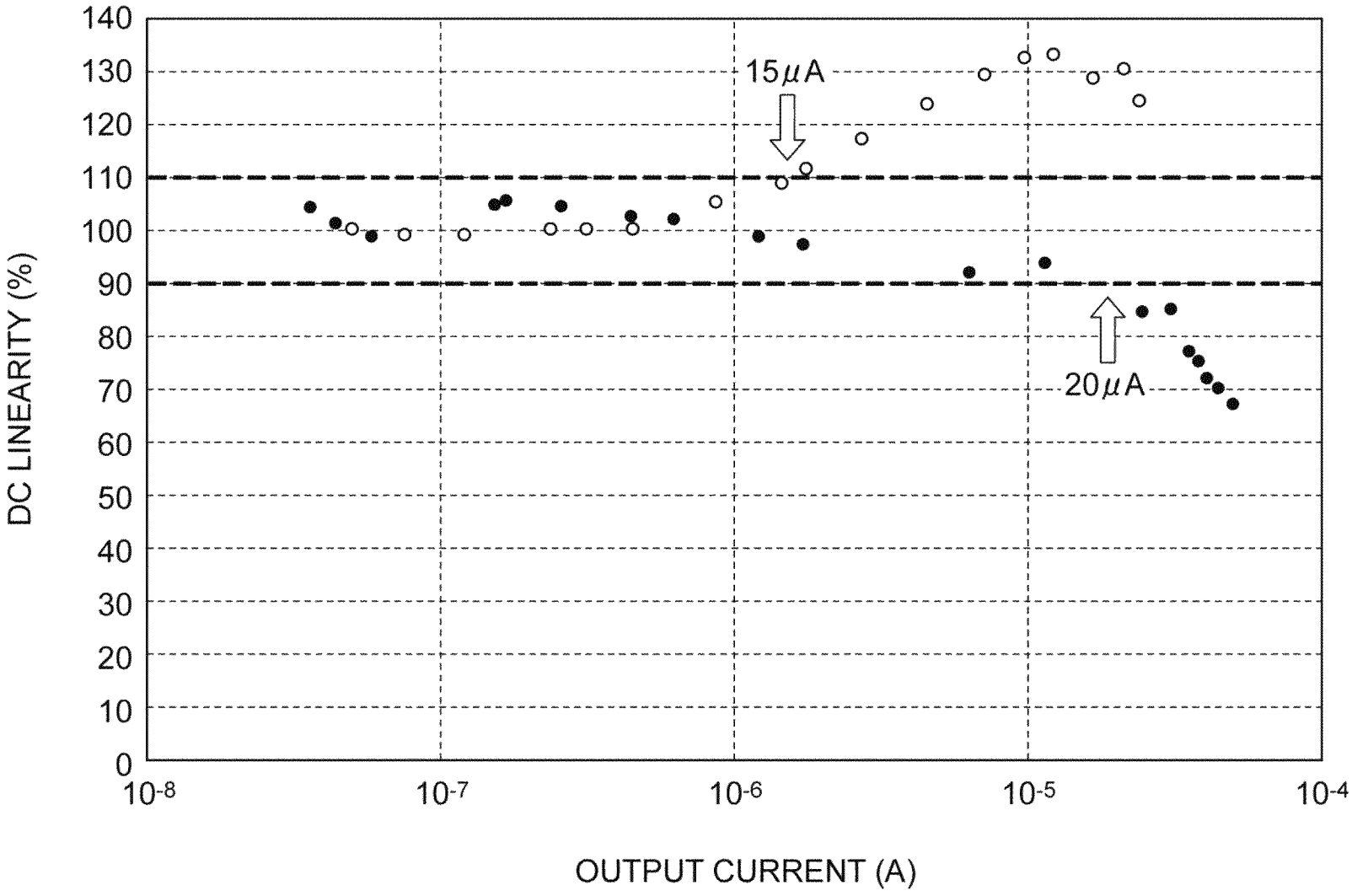
FIG. 7 is a graph illustrating a relation between DC linearity (%) and the output current (A) for each of an electron multiplier device (including a CEM assembly including two power source units) according to a second comparative example and the electron multiplier device according to the second embodiment in FIG. 6.

FIG. 7 is a graph illustrating a relation between DC linearity (%) and the output current (A) for each of an electron multiplier device (including a CEM assembly including two power source units) according to a second comparative example and the electron multiplier device according to the second embodiment in FIG. 6.

In FIG. 7, a graph plotted by symbols "○" indicates a relation between DC linearity (%) and the output current (A) in the electron multiplier device according to the second embodiment in FIG. 6. A graph plotted by symbols "●" indicates a relation between DC linearity (%) and the output current (A) in an electron multiplier device (including a CEM assembly including another power source in addition to the configuration illustrated in FIG. 3A) according to a second comparative example. In the second embodiment, the voltage applied between the input electrode 130A and the output electrode 130B is set to 1500 V. Thus, the potential of the input-side reference node 310 is set to −1600 V, and the potential of the output-side reference node 410 is set to −100 V corresponding to the dropped voltage of the Zener diode. The resistance value of the first resistor 420 is 20 MΩ. In the second comparative example, a power source unit configured to generate an electromotive force of 100 V is provided instead of the constant voltage supply unit 500A configured by the resistor illustrated in FIG. 3A. With the second comparative example, the input-side reference node 310 is set to −1600 V by the power source unit 300, and the output-side reference node 410 is set to −100 V by another power source unit.

In a measurement result of FIG. 7, it is possible to recognize that DC linearity in the third embodiment is deteriorated in comparison to DC linearity in the second comparative example, but clearly improved in comparison to DC linearity in the first comparative example illustrated in FIG. 6.

Figure 8:
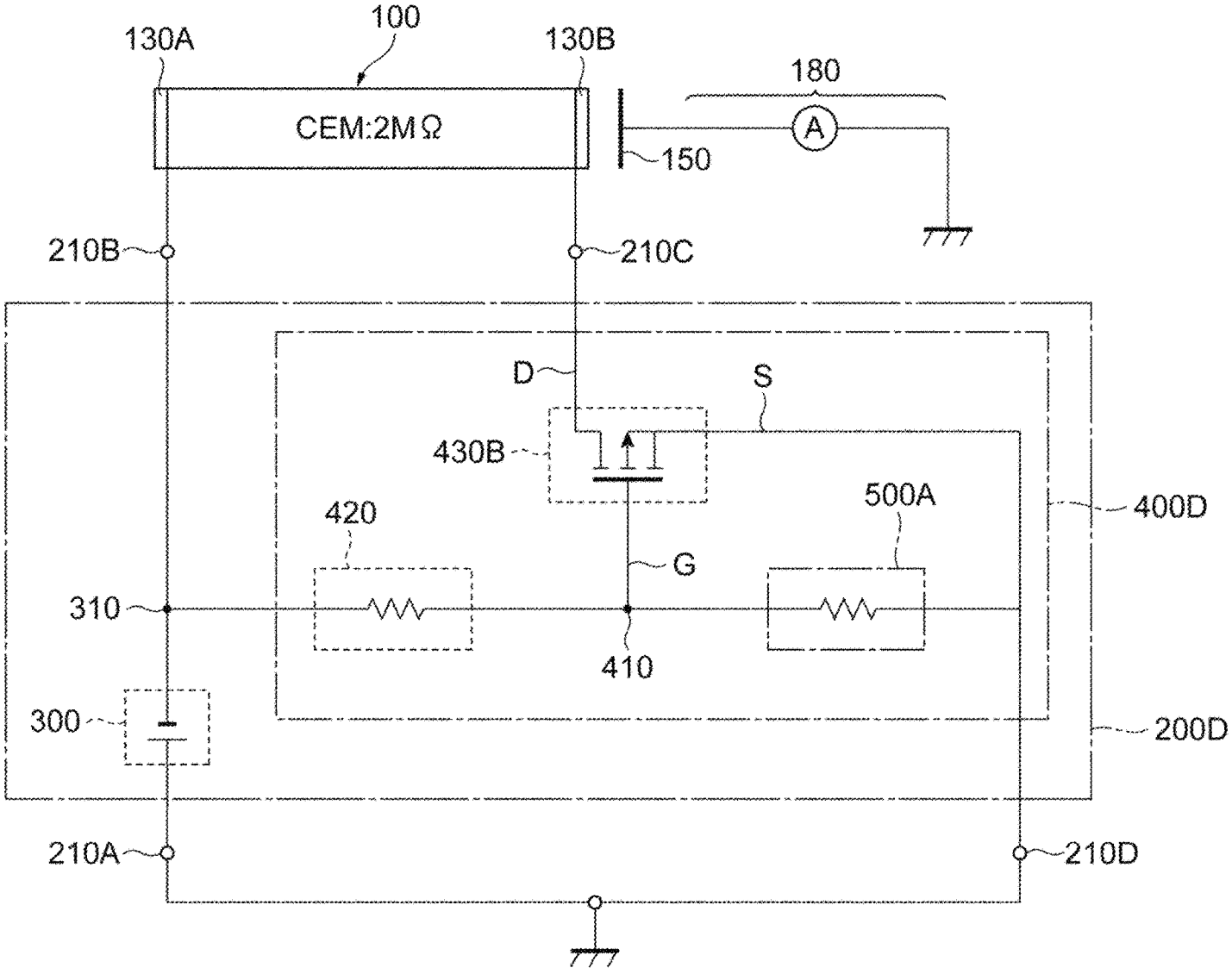
FIG. 8 is a diagram illustrating a specific configuration example (current measurement configuration) of an electron multiplier device (including a CEM assembly according to a third embodiment) according to the third embodiment.

FIG. 8 is a diagram illustrating a specific configuration example of an electron multiplier device (including a CEM assembly according to a third embodiment) according to the third embodiment. In the example in FIG. 8, as the current measurement configuration, the current measurement circuit (including an ammeter A) 180 is connected to the anode 150 that captures secondary electrons from the CEM 100. The configuration illustrated in FIG. 8 corresponds to the configuration illustrated in FIG. 1.

The configuration of the electron multiplier device according to the third embodiment is similar to the configuration in the first embodiment illustrated in FIG. 4 except for a potential fixing element 430B constituting a portion of the CEM assembly according to the third embodiment. That is, the electron multiplier device according to the third embodiment includes the CEM assembly according to the third embodiment, the anode 150, and the current measurement circuit 180 (or the signal output circuit including an amplifier 160 as the signal measurement configuration) connected to the anode 150. The CEM assembly includes the CEM (low-resistance CEM having a resistance value of 2 MΩ) 100 and a voltage supply circuit 200D. The input electrode 130A is provided on the input end side of the CEM 100. The output electrode 130B is provided on the output end side of the CEM 100.

The voltage supply circuit 200D configured to apply a predetermined voltage between the input electrode 130A and the output electrode 130B includes the power source unit 300 configured to generate the entirety of the electromotive force in the circuit, the first to fourth terminals 210A to 210D, and a constant voltage generation unit 400D. The first terminal 210A is set to the ground potential (first and second reference potentials) via the common terminal. The second terminal 210B is connected to the input electrode 130A. The third terminal 210C is connected to the output electrode 130B. Similar to the first terminal 210A, the fourth terminal 210D is set to the ground potential via the common terminal.

In the voltage supply circuit 200D, the input-side reference node 310 is located between the power source unit 300 and the second terminal 210B. The power source unit 300 generates an electromotive force for ensuring a potential difference between the first terminal 210A and the input-side reference node 310. With this configuration, the input-side reference node 310 is set to −1000 to −4000 V.

In the voltage supply circuit 200D, the constant voltage generation unit 400D includes the first resistor 420, a potential fixing element 430B, and the constant voltage supply unit 500A. The first resistor 420 is disposed between the input-side reference node 310 and the output-side reference node 410. The constant voltage generation unit 400D is disposed between the third terminal 210C and the fourth terminal 210D and holds the target potential for fixing the potential of the output electrode 130B. The target potential is set for an output-side reference node 410 which is not influenced by potential fluctuation of the output electrode 130B. Specifically, the potential difference between the fourth terminal 210D and the output-side reference node 410 is ensured by voltage drop by the constant voltage supply unit 500A configured by a resistor (second resistor). The potential fixing element 430B configured by a P-type MOS transistor (described as "a PMOS" below) is disposed between the output-side reference node 410 and the third terminal 210C.

Preferably, the resistance value of the first resistor 420 is higher than the resistance value of the second resistor constituting the constant voltage supply unit 500A. The resistance ratio between the first resistor 420 and the second resistor is set to be within a range of 100:1 to 2:1. A gate G (first element end) of the PMOS is connected to the output-side reference node 410. A drain D (second element end) of the PMOS is connected to the third terminal 210C. A source S (third element end) of the PMOS is connected to the fourth terminal 210D. If $V_{DS}$ of the PMOS is set to be substantially equal to the potential difference between the output-side reference node 410 and the fourth terminal 210D, it is possible to stabilize the potential of the output electrode 130B in a high output of the CEM 100.

In this embodiment, in the potential fixing element 430B, the source S is connected to the fourth terminal 210D, and the gate G is connected to the output-side reference node 410. Generally, in this configuration, $V_{GS}$ exceeds the threshold voltage by voltage drop of the constant voltage supply unit 500A. Thus, the potential fixing element (PMOS) 430B turns into the ON state. In the ON state, electrons flow from the output electrode 130B toward the fourth terminal 210D via the third terminal 210C, but electrons not less than a predetermined amount do not flow. Therefore, even in a case where voltage drop occurs on the output end of the CEM 100, a state where a bias is applied in a direction in which voltage drop is eliminated is normally maintained (at least, the potential difference $V_{DS}$ between the output electrode 130B and the fourth terminal 210D is ensured).

Figure 9:
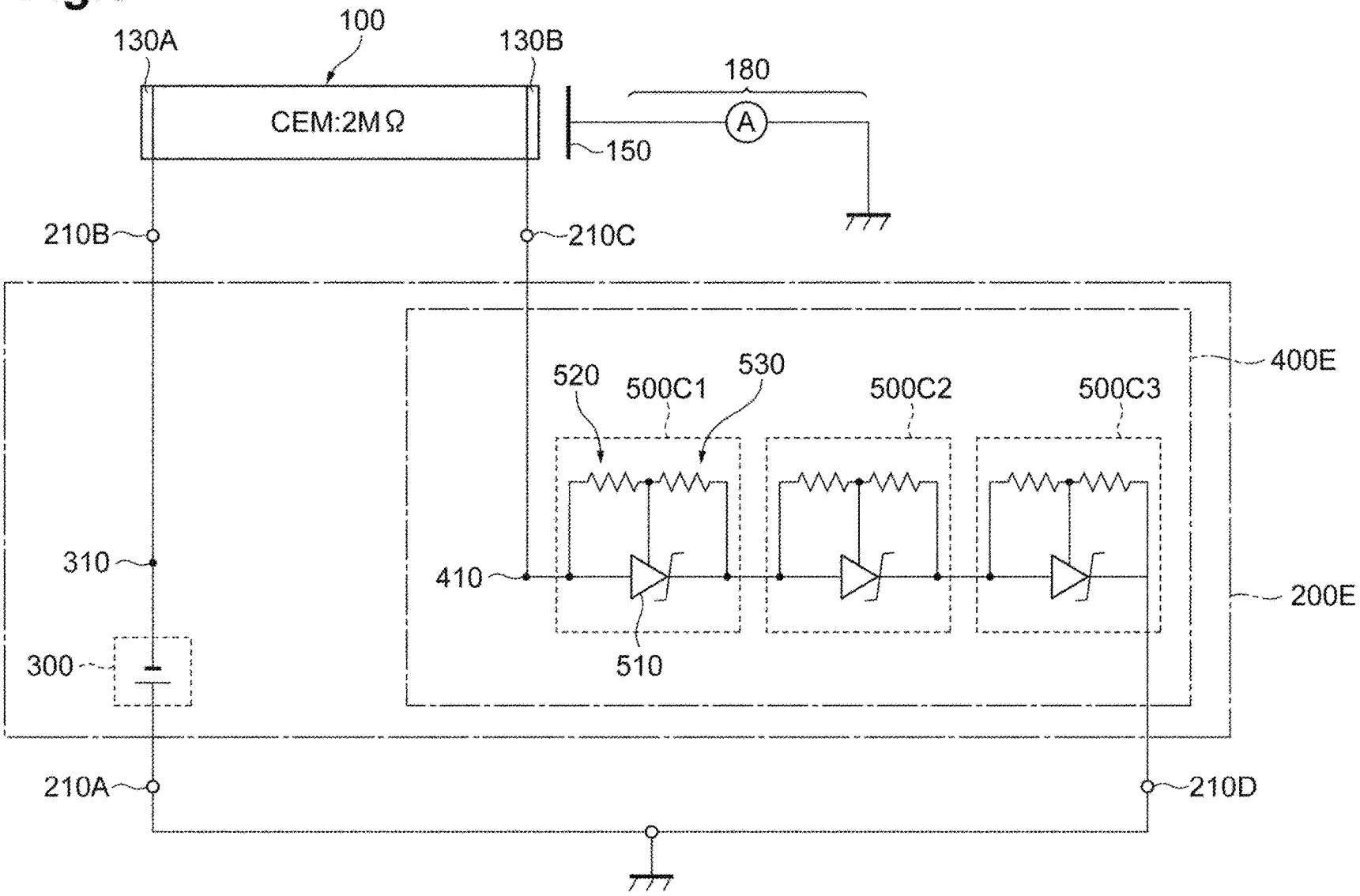
FIG. 9 is a diagram illustrating a specific configuration example (current measurement configuration) of an electron multiplier device (including a CEM assembly according to a fourth embodiment) according to the fourth embodiment.

FIG. 9 is a diagram illustrating a specific configuration example of an electron multiplier device (including a CEM assembly according to a fourth embodiment) according to the fourth embodiment. In the example in FIG. 9, as the current measurement configuration, the current measurement circuit (including an ammeter A) 180 is connected to the anode 150 that captures secondary electrons from the CEM 100. The configuration illustrated in FIG. 9 corresponds to the configuration illustrated in FIG. 1.

The configuration of the electron multiplier device according to the fourth embodiment is similar to the configuration in the first comparative example illustrated in FIG. 3A, except for a voltage supply circuit 200E constituting a portion of a CEM assembly according to the fourth embodiment. That is, the electron multiplier device according to the fourth embodiment includes the CEM assembly according to the fourth embodiment, the anode 150, and the current measurement circuit 180 (or the signal output circuit including an amplifier 160 as the signal output configuration) connected to the anode 150. The CEM assembly includes the CEM (low-resistance CEM having a resistance value of 2 MΩ) 100 and the voltage supply circuit 200E. The input electrode 130A is provided on the input end side of the CEM 100. The output electrode 130B is provided on the output end side of the CEM 100.

The voltage supply circuit 200E configured to apply a predetermined voltage between the input electrode 130A and the output electrode 130B includes the power source unit 300 configured to generate the entirety of the electromotive force in the circuit, the first to fourth terminals 210A to 210D, and a constant voltage generation unit 400E. The first terminal 210A is set to the ground potential (first and second reference potentials) via the common terminal. The second terminal 210B is connected to the input electrode 130A. The third terminal 210C is connected to the output electrode 130B. Similar to the first terminal 210A, the fourth terminal 210D is set to the ground potential via the common terminal.

In the voltage supply circuit 200E, the input-side reference node 310 is located between the power source unit 300 and the second terminal 210B. The power source unit 300 generates an electromotive force for ensuring a potential difference between the first terminal 210A and the input-side reference node 310. With this configuration, the input-side reference node 310 is set to −1000 to −4000 V.

In the voltage supply circuit 200E, the constant voltage generation unit 400E includes the output-side reference node 410 and a plurality of IC units 500C1 to 500C3 corresponding to the constant voltage supply unit 500 illustrated in FIG. 1, the constant voltage supply unit 500A illustrated in FIGS. 3A, 4, and 8, and the constant voltage supply unit 500B in FIG. 6. The output-side reference node 410 is connected to the output electrode 130B via the third terminal 210C (same potential as that of the output electrode 130B). The IC units 500C1 to 500C3 are directly disposed between the output-side reference node 410 and the fourth terminal 210D. Each of the IC units 500C1 to 500C3 includes a shunt regulator IC 510, a third resistor 520, and a fourth resistor 530. The third resistor 520 and the fourth resistor 530 are connected in series between an input end and an output end of the shunt regulator IC 510 at a predetermined resistance ratio.

For example, a case where voltage drop on the output side of the CEM 100 (the potential of the output electrode 130B is decreased) is considered. In this case, in the IC unit 500C1, since the potential difference between the fourth terminal 210D and the output-side reference node 410 increases, the shunt regulator IC 510 causes electrons from the output electrode 130B to pass (short-circuited state) at a time point at which the above potential difference exceeds a reference voltage of the shunt regulator IC 510 set at a resistance ratio between the third resistor 520 and the fourth resistor 530. The target potential of the output-side reference node 410 rises in a period in which the electrons pass through the shunt regulator IC 510. Thus, the potential of the output electrode 130B connected to the output-side reference node 410 also rises (elimination of voltage drop at the output end of the CEM 100). In a case where voltage drop occurs largely, the above-described operation is performed in order of the IC unit 500C2 and the IC unit 500C3. If the voltage drop on the output side of the CEM 100 is eliminated, the potential of the output-side reference node 410 is restored to the target potential before the operation of each of the IC units 500C1 to 500C3, by voltage drop of the third resistor 520 and the fourth resistor 530 which are connected in series in each of the IC units 500C1 to 500C3.

Figure 10:
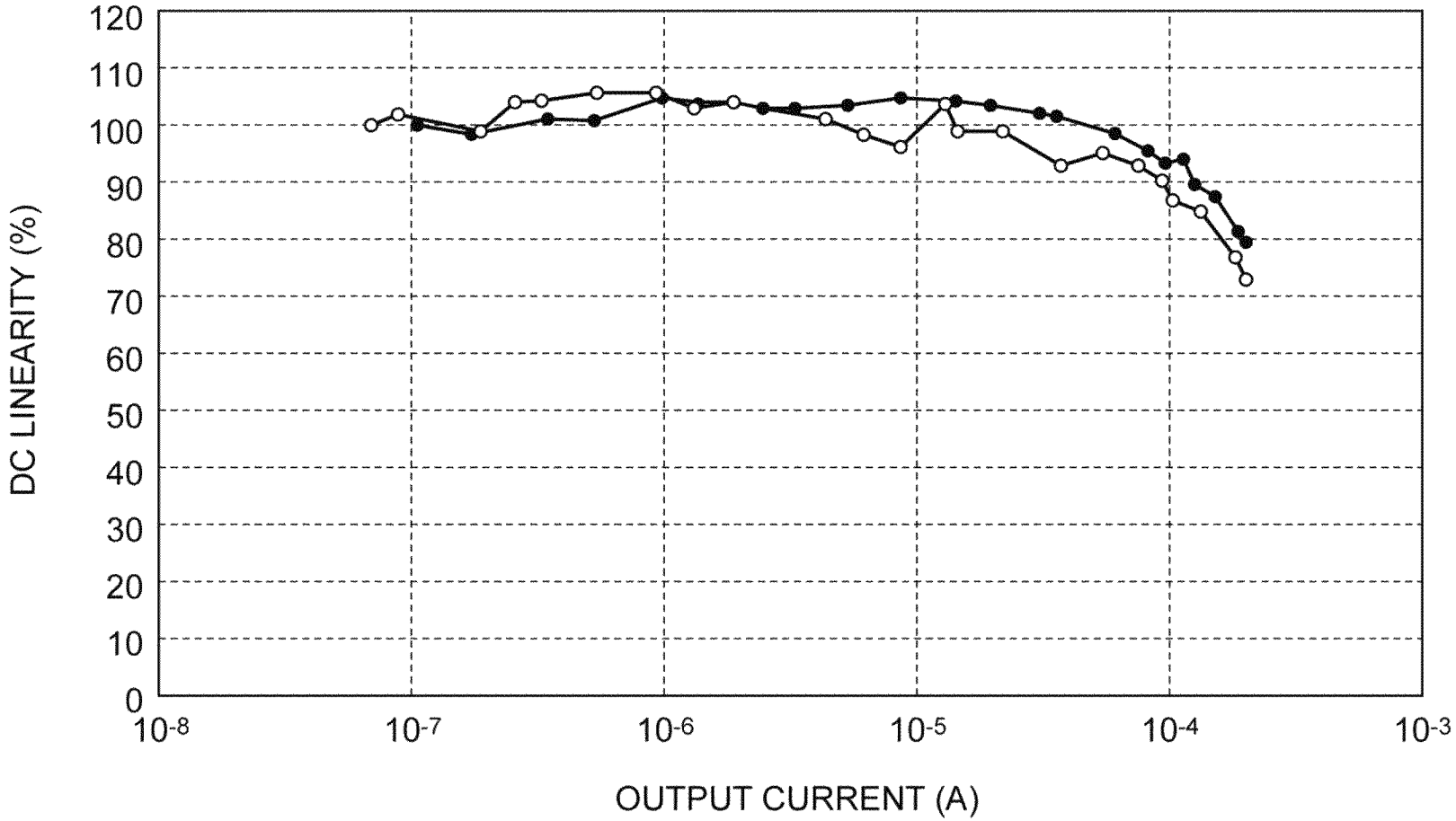
FIG. 10 is a graph illustrating a relation between DC linearity (%) and the output current (A) for each of the electron multiplier device (including the CEM assembly including the two power source units) according to the second comparative example and the electron multiplier device according to the fourth embodiment in FIG. 9.

FIG. 10 is a graph illustrating a relation between DC linearity (%) and the output current (A) for each of the electron multiplier device (including the CEM assembly including the two power source units) according to the second comparative example and the electron multiplier device according to the fourth embodiment in FIG. 9.

In FIG. 10, a graph plotted by symbols "○" indicates a relation between DC linearity (%) and the output current (A) in the electron multiplier device according to the fourth embodiment in FIG. 9. A graph plotted by symbols "●" indicates a relation between DC linearity (%) and the output current (A) in the electron multiplier device (configuration including another power source in addition to the configuration illustrated in FIG. 3A) according to a second comparative example. In the fourth embodiment, the potential of the input-side reference node 310 is set to −1600 V, and the potential of the output-side reference node 410 is set to −100 V corresponding to the voltage drop of the third resistor 520 and the fourth resistor 530 in each of the IC units 500C1 to 500C3. The resistance value of the first resistor 420 is 20 MΩ. In the second comparative example, a power source unit configured to generate an electromotive force of 100 V is provided instead of the constant voltage supply unit 500A configured by the resistor illustrated in FIG. 3A. In this case, in the second comparative example, the input-side reference node 310 is set to −1600 V by the power source unit 300, and the output-side reference node 410 is set to −100 V by another power source unit.

As understood from FIG. 10, it is possible to recognize that DC linearity in the fourth embodiment sufficiently follows DC linearity in the second comparative example including the CEM assembly having two power sources. The reason that DC linearity in the fourth embodiment is slightly lower than DC linearity in the second comparative example is that the potential is adjusted for each IC unit in the fourth embodiment.

According to this embodiment, since the target potential as an adjustment target of the output potential is set in the output-side reference node which is not influenced by fluctuation of the output potential of the CEM, it is possible to fix the output potential to the target potential even in the voltage supply circuit including only a single power source unit. In particular, regarding the fixation of the target potential, considering individual differences in resistance values between a plurality of manufactured CEMs is not required.

From the above descriptions of the present invention, it is apparent that the present invention can be modified in various ways. Such modifications cannot be construed as departing from the spirit and scope of the present invention, and improvements which are obvious to one skilled in the art are intended to be included within the scope of the following claims.

What is claimed is:

1. A CEM assembly comprising:

(1) a channel electron multiplier including:

a multiplication channel having an input end for taking charged particles in, an output end for emitting secondary electrons, and a secondary electron emission layer continuously provided from the input end toward the output end;

an input electrode provided at the input end in a state of being in contact with the secondary electron emission layer; and an output electrode provided at the output end in a state of being in contact with the secondary electron emission layer; and (2) a voltage supply circuit configured to apply a predetermined voltage between the input electrode and the output electrode, the voltage supply circuit including:

a first terminal set to a first reference potential;

a second terminal connected to the input electrode;

a third terminal connected to the output electrode;

a fourth terminal set to a second reference potential;

a power source unit disposed between the first terminal and the second terminal to generate an electromotive force for ensuring a potential difference between the first terminal and an input-side reference node, the input-side reference node being set to the same potential as the potential of the input electrode via the second terminal; and a constant voltage generation unit disposed between the third terminal and the fourth terminal to hold a target potential for adjusting a potential of the output electrode, the constant voltage generation unit having an output-side reference node set to the target potential and located between the third terminal and the fourth terminal, and a constant voltage supply unit provided to cause voltage drop for ensuring a potential difference between the fourth terminal and the output-side reference node.

2. The CEM assembly according to claim 1, wherein the constant voltage generation unit further includes a first resistor disposed between the input-side reference node and the output-side reference node, and a potential fixing element provided to eliminate a potential difference between the output electrode and the output-side reference node via the third terminal.

3. The CEM assembly according to claim 2, wherein the constant voltage supply unit further includes a second resistor disposed between the output-side reference node and the fourth terminal.

4. The CEM assembly according to claim 3, wherein a resistance value of the first resistor is higher than a resistance value of the second resistor.

5. The CEM assembly according to claim 3, wherein a resistance ratio between the first resistor and the second resistor falls within a range of 100:1 to 2:1.

6. The CEM assembly according to claim 2, wherein the constant voltage supply unit further includes a Zener diode disposed between the output-side reference node and the fourth terminal.

7. The CEM assembly according to claim 2, wherein the potential fixing element includes any one of a MOS transistor, a FET, and a bipolar transistor.

8. The CEM assembly according to claim 1, wherein the constant voltage supply unit further includes one or more IC units connected in series between the output-side reference node and the fourth terminal, and each of the IC units includes a shunt regulator IC, a third resistor, and a fourth resistor, the third resistor and the fourth resistor being connected in series between an input end and an output end of the shunt regulator IC at a predetermined resistance ratio.

9. The CEM assembly according to claim 1, wherein the multiplication channel further includes:

a structural body provided to support the secondary electron emission layer, the structural body being comprised of an insulating material; and a resistive film provided between the secondary electron emission layer and the structural body.

10. The CEM assembly according to claim 9, wherein the insulating material includes ceramic or glass excluding lead glass.

11. The CEM assembly according to claim 1, wherein a resistance value of the multiplication channel located between the input electrode and the output electrode is less than 10 MΩ.

12. An electron multiplier device comprising:

the CEM assembly according to claim 1; and an anode disposed so as to face the output end of the channel electron multiplier constituting a portion of the CEM assembly.

* * * * *